US005278409A

United States Patent [19]

Bonner

[11] Patent Number: 5,278,409

[45] Date of Patent: Jan. 11, 1994

[54] ELECTRODE ASSEMBLY POSITIONING APPARATUS

[75] Inventor: William H. Bonner, Cedarburg, Wis.

[73] Assignee: Pillar Technologies, Hartland, Wis.

[21] Appl. No.: 974,921

[22] Filed: Nov. 12, 1992

[51] Int. Cl.[5] ..... H01T 19/04

[52] U.S. Cl. ..... 250/325; 250/324

[58] Field of Search ..... 250/324, 325, 492.3, 250/491.1

[56] References Cited

U.S. PATENT DOCUMENTS

| | | | |
|---|---|---|---|
| 4,493,973 | 1/1985 | Muhl | 392/315 |
| 4,556,795 | 12/1985 | Tietje | 250/325 |
| 4,636,640 | 1/1987 | Majewski | 250/325 |

FOREIGN PATENT DOCUMENTS

| | | | |
|---|---|---|---|
| 2806551 | 8/1979 | Fed. Rep. of Germany | 250/325 |

*Primary Examiner*—Bruce C. Anderson

*Attorney, Agent, or Firm*—Andrus, Sceales, Starke & Sawall

[57] ABSTRACT

An apparatus for positioning the electrode assembly of a corona treater includes a rotatable cylinder to which the electrode assembly is attached. A counterweight is disposed on the cylinder substantially opposite the electrode assembly and the counterweight causes a torque equal and opposite to that created by the electrode assembly. A pneumatic piston is utilized to rotate the cylinder between its operative and threading positions.

4 Claims, 2 Drawing Sheets

ELECTRODE ASSEMBLY POSITIONING APPARATUS

BACKGROUND OF THE INVENTION

The present invention relates to corona treaters and more specifically to an assembly for positioning the electrode assembly in the corona treater.

In the past, the electrode assembly of a corona treater has been held in position by gravity and/or a biasing spring. When the assembly was moved to a threading position, the biasing spring would be overcome and the electrode assembly would be repositioned to its treating position by the spring and/or gravity. This gravity/-spring combination severely limits the positions in which the station may be mounted. For example, stations cannot be located alongside or below the web because the gravity/spring system would not maintain the electrode assembly in the proper position without modifying the assembly which adds to the cost and makes installation more complex.

It is an object of the present invention to provide an electrode assembly positioning apparatus that is completely independent of gravity and thus allows installation of the station in any position.

SUMMARY OF THE INVENTION

An electrode assembly positioning apparatus for a corona treater includes a rotatable cylinder mounted in the corona treater with its axis parallel to the axis of the treating roller.

In accordance with one aspect of the invention, an electrode assembly is mounted to and extends outwardly from the cylinder so that rotation of the cylinder causes movement of the electrode assembly from an operative position in which the electrode assembly is adjacent the web to a threading position in which the electrode assembly is removed from the treating zone.

In accordance with another aspect of the invention, a counterweight is mounted to the cylinder substantially opposite the electrode assembly in such a way to cause a torque on the cylinder equal and opposite to that caused by the electrode assembly.

In accordance with yet another aspect of the invention, a positioning means is operably connected to the cylinder to selectively rotate the cylinder between the operative position and the threading position.

In accordance with still another aspect of the invention, a detection means is provided that monitors the position of the cylinder and deactivates the corona treater when the cylinder is out of the operating position.

The present invention thus provides a positioning assembly for the electrode assembly of a corona treater which is independent of gravity so as to allow the station to be mounted in any position relative to the web being treated.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
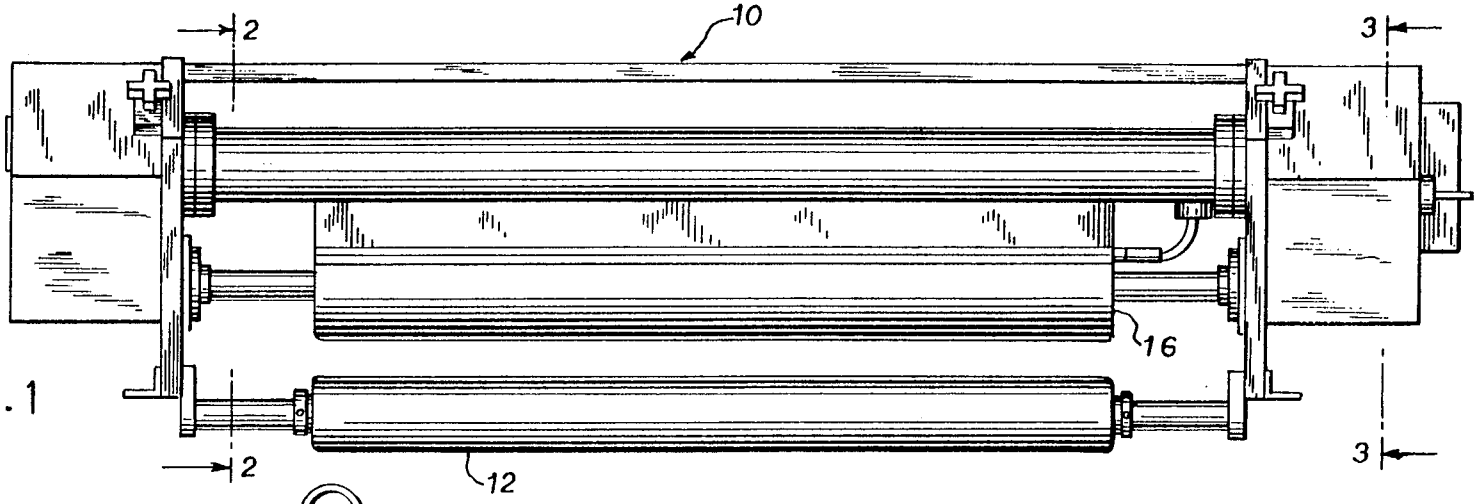
FIG. 1 is a front view of a corona treater assembled according to the present invention.
Figure 2:
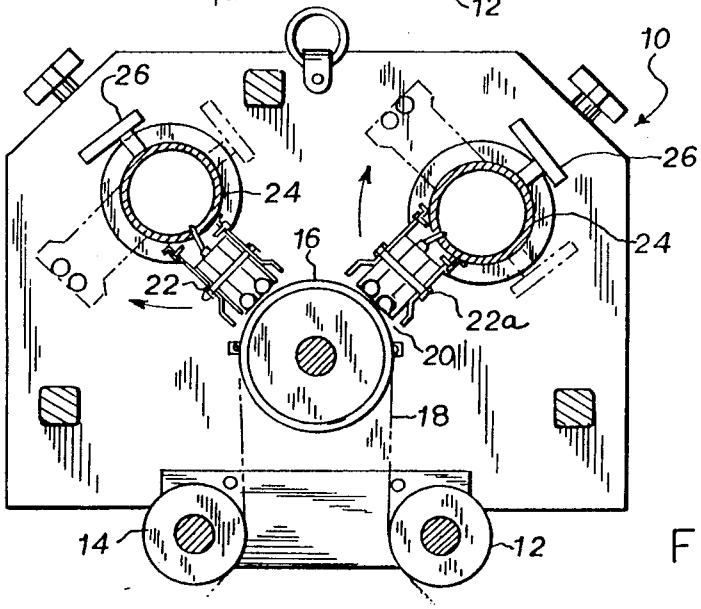
FIG. 2 is a sectional view along the line 2—2 of FIG. 1 with rotation of the electrode assembly to its threading position shown in phantom.
Figure 3:
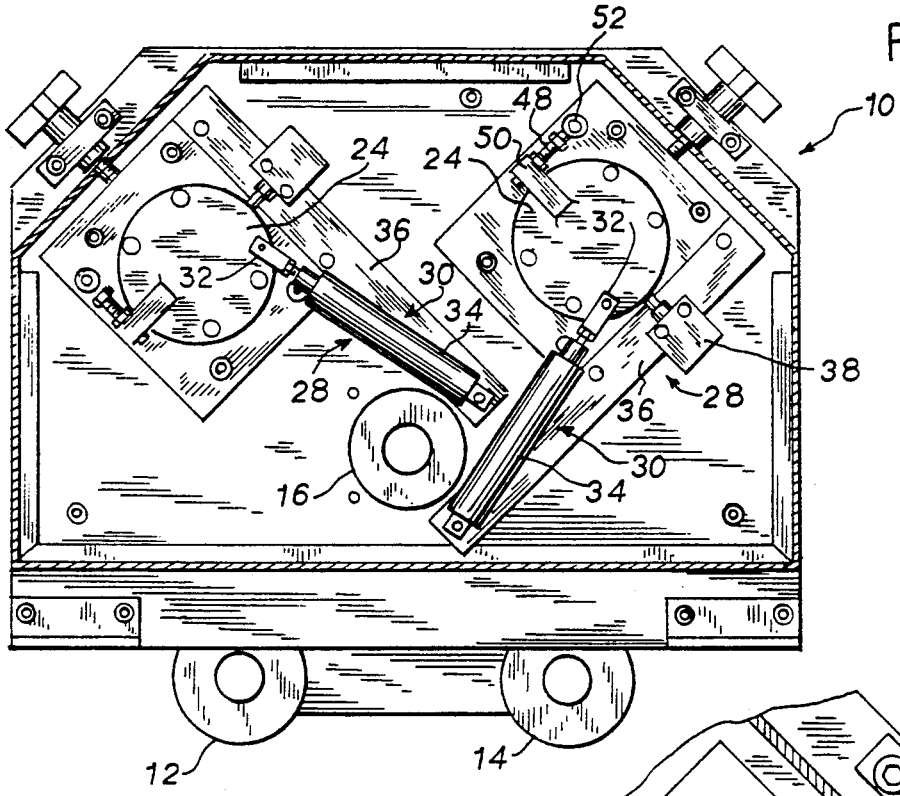
FIG. 3 is a sectional view along the line 3—3 of FIG. 1.

As seen in FIGS. 1-3, a corona treater 10 includes a pair of web guide rollers 12 and 14 and a treatment roller 16. A web of material, typically plastic, is guided into the treatment zone 20 by guide rollers 12 and 14 and treatment roller 16. While the invention can be utilized with any number of electrode assemblies, this embodiment shown a pair of electrode assemblies 22 and **22*a* are positioned substantially adjacent web 18 when corona treater 10** is in operation.

As seen in FIG. 2, each of electrode assemblies 22 and **22*a* is mounted on its own cylinder 24. A counterweight 26 is also mounted on the cylinder at a point substantially opposite the electrode assembly. Counterweight 26 is of a weight and position such that it causes a torque substantially equal to and opposite to that caused by its corresponding electrode assembly. Thus, electrode assemblies 22 and 22*a*** are substantially free floating.

A positioning means 28 is provided for each of cylinders 24. Positioning means 28 consists of a pneumatic actuator 30 having its rod end 32 connected to cylinder 24 and its cylinder end 34 connected to a rigid framework 36 on which rotatable cylinder 24 is mounted.

Figure 4:
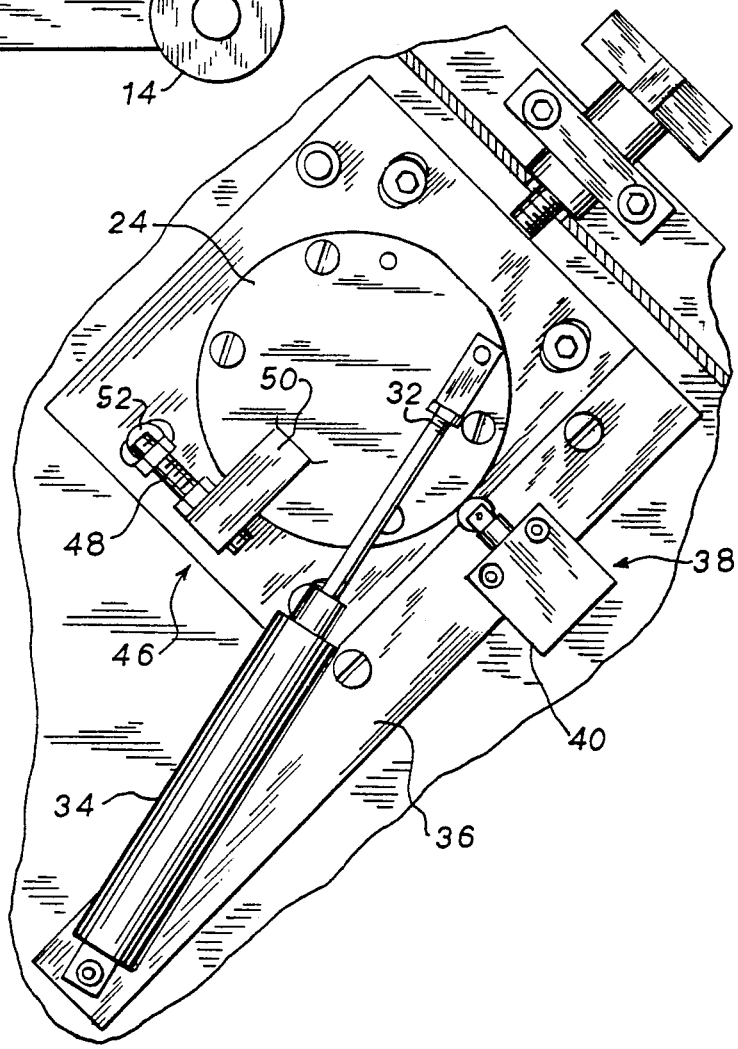
FIG. 4 is an enlarged view of the air cylinder and limit switch of FIG. 3.

As shown in FIGS. 2 and 4, the extension of rod 32 causes cylinder 24 to rotate to its threading position (phantom in FIG. 2). In this position, web 18 may be wound around rollers 12, 14 and 16 without interference from electrode assembly 22 or **22*a*. The retraction of rod 32 causes cylinder 24 to rotate so as to bring electrode assembly 22 into its operative position in which assembly 22 is substantially adjacent web 18. Counterweight 26 effectively negates the torque created by electrode assembly 22** and thus the essentially free floating assembly may be easily positioned by a pneumatic cylinder operating at a level of approximately 5 psi. This relatively low biasing pressure allows the essentially free floating electrode assemblies to easily move out of their operating positions should they encounter an interference such as a splice in the web material passing through the treating zone. Once the interference has passed, the low pressure biasing force will return the electrode assemblies to their operating positions.

Figure 5:
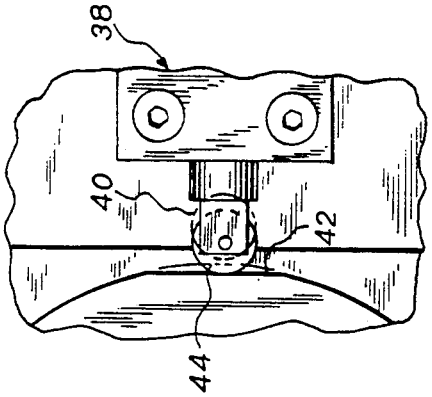
FIG. 5 is an enlarged side view of the limit switch in FIG. 4.

As shown in FIGS. 3, 4 and 5, the positioning assembly is provided with detection means 38 in the form of a reciprocating limit switch 40. As seen in FIG. 5, limit switch 40 is allowed to move to its outer position when flat 42 is rotated into engagement with roller 44. In this outer position, detection means 38 senses that cylinder 24 is in its operative position and operation of corona treater 10 is allowed. When cylinder 24 rotates out of its operating position (phantom is FIG. 2), the curved surface of cylinder 24 engages roller 44 and urges it inwardly. In this position, corona treater 10 is rendered inoperative. It is preferred to have limit switch 40 render corona treater 10 inoperative in its inner position since the tendency is for the switch to become stuck at that position and it is preferable to have the switch stuck in an inoperative condition rather than an operative condition.

Cylinder 24 is also provided with an adjustable stop assembly 46 that consists of a threaded bolt 48 mounted on arm 50 that extends from cylinder 24. The engagement of bolt 48 with cushioned stop pin 52 limits the rotation of cylinder 24 and thus provides a consistent and accurate positioning of electrode assembly 22.

In operation of corona treater 10, cylinder rod 32 is extended so as to rotate cylinder 24 and electrode assembly 22 into its threading position. In this position, web 18 can be threaded around and between rollers 12, 14 and 16 and corona treater 10 will be rendered inoperative due to the fact that limit switch 40 has been pushed to its inner position.

After threading web 18 into corona treater 10, rod 32 is retracted and cylinder 24 is rotated so as to bring electrode assembly 22 into its operating position adjacent web 18. In this position, flat 42 moves adjacent to roller 44 and limit switch 40 is allowed to move to its outer position in which corona treater 10 is made operative.

If during operation the electrode assemblies should encounter an interference on the web, they will easily move out of the operating position and this will be sensed by the limit switch and the corona treater will be rendered inoperative.

The present invention thus provides a simple mechanical assembly for positioning the electrode assemblies in their operative and threading positions. The positioning assembly is independent of gravity and thus allows the treating stations to be positioned in any position relative to the web. The present invention also provides a detection means for monitoring the position of the electrode assemblies and preventing operation of the corona treater when the electrode assemblies are out of their operating position.

The substantially free floating electrode assemblies biased by low operating pressure prevents damage to the electrode assemblies or the web in the event that an interference passes through the treating zone.

Various modes of carrying out the invention are contemplated as being within the scope of the following claims particularly pointing out and distinctly claiming the subject matter regarded as the invention.

I claim:

1. An apparatus for positioning the electrode assembly of a corona treater in which a web of material is passed over a roller through a treating zone, said apparatus comprising:

a rotatable cylinder mounted in the corona treater with its axis substantially parallel to the axis of the treating roller, an electrode apparatus mounted to and extending outwardly from said cylinder whereby rotation of said cylinder causes movement of said electrode assembly from an operative position in which said electrode assembly is substantially adjacent the web in the treating zone to a threading position in which said electrode assembly is removed from the treating zone, a counterweight mounted to said cylinder substantially opposite said electrode assembly and causing a torque on said cylinder substantially equal and opposite to that caused by said assembly, and positioning means operably connected to said cylinder to selectively rotate said cylinder between said operative position and said threading position.

2. The apparatus defined in claim 1 wherein said positioning comprises a pneumatic piston having its rod connected to said cylinder and its cylinder mounted on a rigid framework in which said rotatable cylinder is mounted.

3. The apparatus defined in claim 1 further comprising means for detecting the position of said cylinder and deactivating the corona treater when said cylinder is out of said operating position.

4. The apparatus defined in claim 3 wherein said detection means comprises a reciprocating limit switch movable between an inner and outer position and in contact with the surface of said cylinder and a flat on said cylinder surface whereby said flat surface is presented to said switch when said cylinder is in said operative position so that said switch can move to its outer position and said switch is moved inwardly when said cylinder is out of said operating position so as to deactivate the corona treater.

* * * * *